United States Patent [19]

Shill

[11] Patent Number: 4,700,941

[45] Date of Patent: Oct. 20, 1987

[54] CORRUGATED SHEET UNSTACKING AND FEEDING APPARATUS

[75] Inventor: David Shill, Newman Lake, Wash.

[73] Assignee: Thermoguard Equipment Inc., Spokane, Wash.

[21] Appl. No.: 866,162

[22] Filed: May 22, 1986

[51] Int. Cl.[4] ..... B65H 1/22

[52] U.S. Cl. ..... 271/151; 271/146; 271/157; 271/221; 414/36

[58] Field of Search ..... 271/3.1, 149, 150, 151, 271/157, 146, 221, 222; 414/28, 36

[56] References Cited

U.S. PATENT DOCUMENTS

| | | | |
|---|---|---|---|
| 3,420,387 | 1/1969 | Baum | 414/36 X |
| 3,643,939 | 2/1972 | Nussbaum | 271/221 X |
| 3,815,762 | 6/1974 | Hoke | 271/146 X |
| 3,842,995 | 10/1974 | Dooley | 414/28 |
| 3,902,586 | 9/1975 | Hill | 414/36 X |
| 4,009,789 | 3/1977 | Runyan | 271/221 X |
| 4,346,882 | 8/1982 | Pessina | 271/221 |

*Primary Examiner*—Richard A. Schacher

*Attorney, Agent, or Firm*—Wells, St. John & Roberts

[57] ABSTRACT

A corrugated sheet stacking and feeding apparatus is provided in which stacks of sheets are fed to the unstacking apparatus and are raised to an elevated position in which blocks are progressively removed from the top of the stack and pushed and fed onto an inverting carriage that receives the blocks and pivots the blocks vertically upward and then to an inverted position over a feed conveyor. While the block of sheets are raised to a vertical orientation, alignment elements move inward along the lateral sides to align the lateral edges of the sheets with respect to each other and to laterally shift the block to align the block with a central feed axis. The block then is lowered onto the feed conveyor and moved forward through a shingling gate to feed the sheets progressively in a shingled fashion to a discharge end of the conveyor.

6 Claims, 11 Drawing Figures

CORRUGATED SHEET UNSTACKING AND FEEDING APPARATUS

TECHNICAL FIELD

The present invention relates to the unstacking and feeding of corrugated sheet material in a shingled fashion.

BACKGROUND OF THE INVENTION

In the manufacture of corrugated paper cases or boxes, case blank sheets are first fabricated in a machine known as a corrugator. The sheets are then generally formed into a stack for storage. At an appropriate time, it is desirable to unstack the sheets and process the sheets one at a time through a printer or other finishing machine to satisfy a particular order of a customer.

It has been found that because of the high rate at which printing machines operate, it is desirable to unstack the sheets and place the sheets in a shingled arrangement to feed the sheets one at a time to a printing machine or like finishing machine.

Thus it is a principal advantage of this invention to provide corrugated sheet unstacking apparatus for economically and efficiently unstacking the corrugated sheets and accurately aligning the sheets and delivering the sheets in a shingled arrangement to the input of a machine such as a printer for further processing of the sheets.

BRIEF DESCRIPTION OF THE DRAWINGS

The preferred embodiment of the invention is illustrated in the accompanying drawings, in which.

DETAILED DESCRIPTION OF THE PREFERRED EMBODIMENT

In compliance with the constitutional purpose of the Patent Laws "to promote the progress of science and useful arts" (Article 1, Section 8), applicant submits the following disclosure of the invention.

Figure 1:
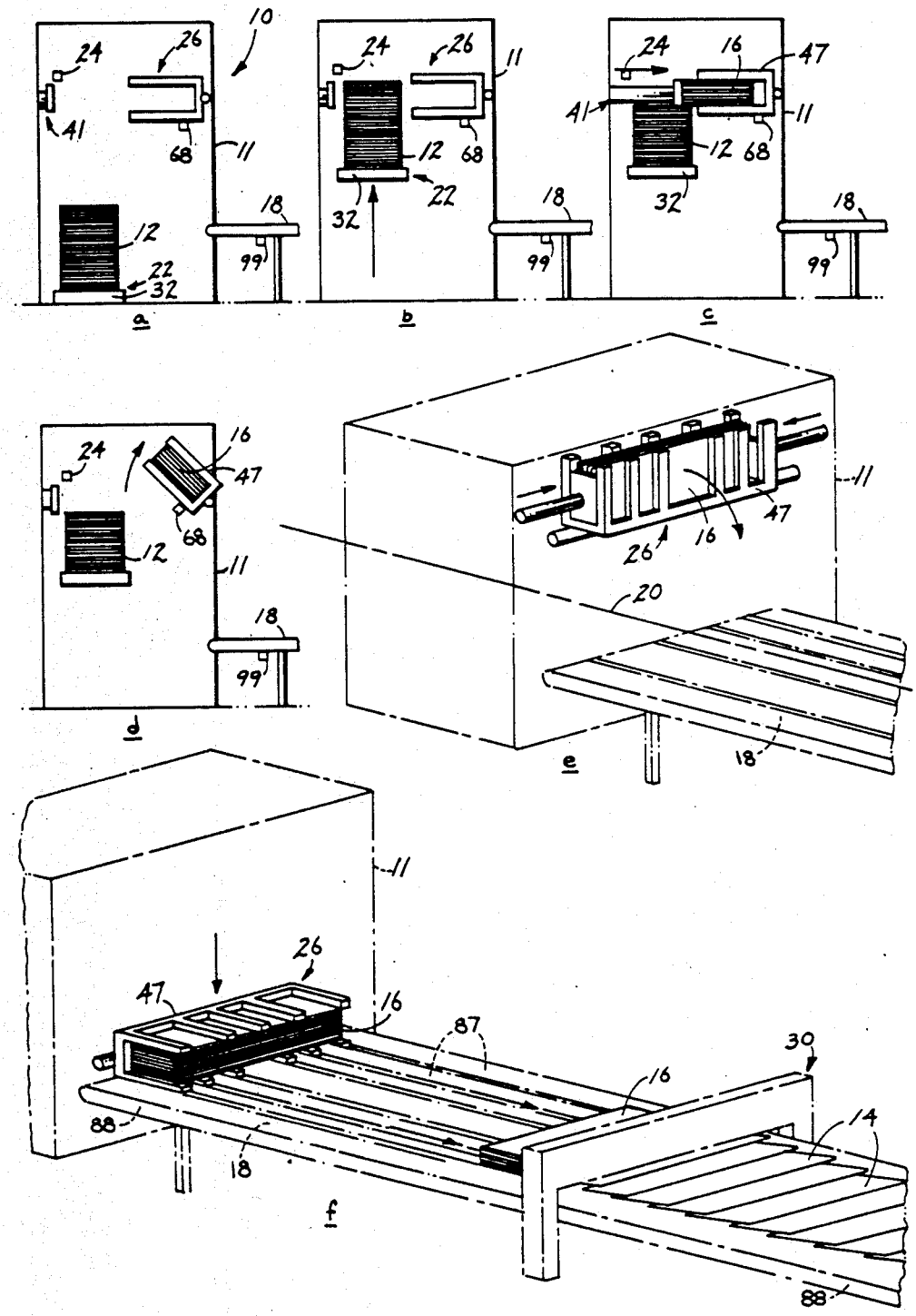
FIG. 1 illustrates a series of diagrammatical, elevational views 1*a*–1*f*, showing the progression of the corrugated sheets through an apparatus to unstack the sheets, align the sheets, and feed the sheets in a shingled arrangement to downstream machinery.

A corrugated sheet unstacking and feed apparatus is generally illustrated in the accompanying drawings and identified with the numeral 10. The apparatus 10 includes a general frame 11. The apparatus receives a stack 12 of corrugated sheet material. The corrugated sheet material is generally used for making corrugated cases or boxes. The sheet material may be fed to the apparatus 10 by an upstream conveyor, or may be loaded manually with a forklift or the like. The stack 12 includes a plurality of superimposed, individual corrugated sheets 14, in which a block 16 of sheets is removed form the top of the stack, as illustrated in Fig.1. The block 14 is laterally aligned and deposited on a feed conveyor 18 for shingling and feeding the sheets one at a time to a downstream piece of equipment, such as a corrugated sheet printer (not shown).

The apparatus 10 and the feed conveyor 18 have an alignment axis, or center axis 20, that is aligned with the downstream equipment for feeding the sheets in a shingled arrangement, with the sheets being laterally aligned with the alignment axis 20 to accurately feed the sheets 14 to the printer.

The apparatus 10 includes a lifting or elevating means 22 for receiving the stack 12 at a lower elevation as indicated in FIG. 1*a*, and for lifting the stack 12 to an elevated position as illustrated in FIG. 1b. A sensing means 24 is positioned on the frame 11 to sense when the top of the stack has reached the desired elevation. The sensor controls the lifting and elevating means 22, to progressively raise the stack as each block 16 is removed from the stack.

The apparatus 10 further includes block handling means 26 adjacent the upper portion of the frame for removing the uppermost block 16 of sheets from the elevated stack 12, and inverting the block 16 of sheets as illustrated in FIGS. 1*d*–1*f*. As the block of sheets is being inverted, the sheets are additionally being aligned with each other within the block of sheets (FIG. 1*e*), and the block itself is being laterally aligned with respect to alignment axis 20. After the sheets have been aligned, the inverted block is placed on the feed conveyor 18 (FIG. 1*f*). A feed conveyor drive means (not shown) moves the feed conveyor to propel the block forward from a receiving end 88 to a discharge end 89. A shingling means 30 is mounted on the feed conveyor intermediate the receiving end 88 and the discharge end 89 for engaging the block, and for shingling the sheets in an overlapping relationship to feed the sheets to the downstream piece of equipment, as illustrated in FIG. 1*f*.

Figure 2:
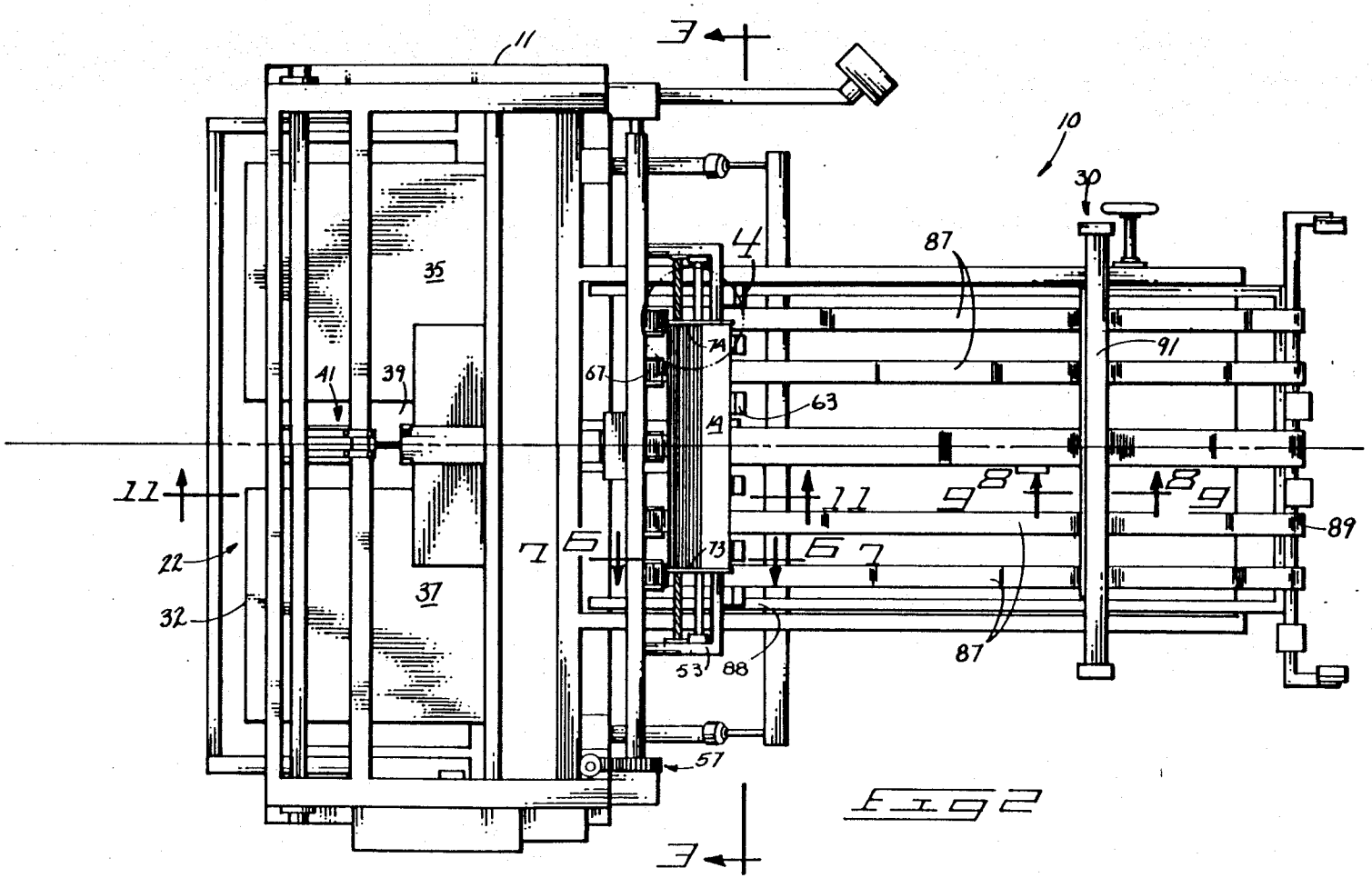
FIG. 2 is a plan view of the apparatus.
Figure 11:
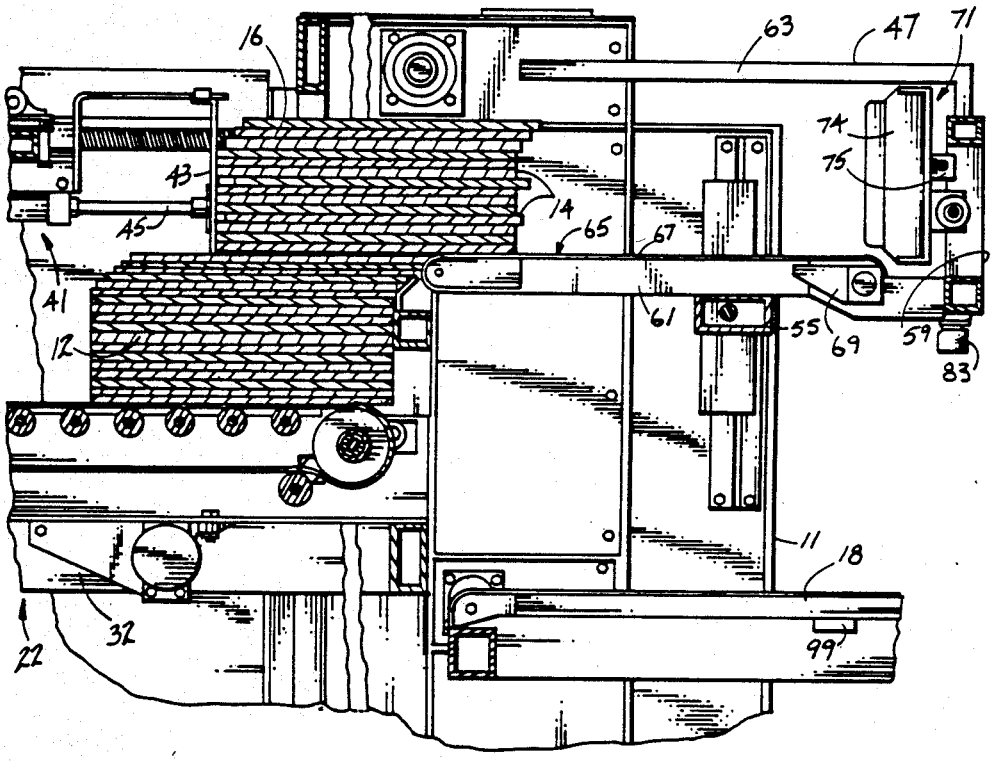
FIG. 11 is a vertical cross-sectional view illustrating means for unloading a block of sheets from the top of an elevated stack, and moving the block onto the block handling means preparatory to inverting the block and placing the block on the feed conveyor.

As illustrated in FIGS. 2 and 11, the lifting or elevating means 22 includes a platform 32 for receiving a load or stack 12 of corrugated sheets. The platform 32 has two platform sections 35 and 37 that have a platform recess 39 formed therein to accommodate a block removal means 41 that is adjacent the upper portion of the frame. The sensor 24 is positioned adjacent the upper portion of the frame for sensing the top of the stack 12 to set the height of the stack at a desired elevation in front of the block removing means 41.

The block removing means 41 is included as part of the block handling means 26. The block removing means 41 has a pusher plate 43 (FIG. 11) for engaging a portion of the top of the stack to define the block 16 of sheets, and for pushing the block 16 from the top of the stack 12. The block removing means 41 includes a pusher drive 45, preferably a fluid cylinder for pushing the pusher plate 43 at the appropriate time to push a block 16 of the sheets from the top of the stack into a block inverting carriage 47.

Figure 3:
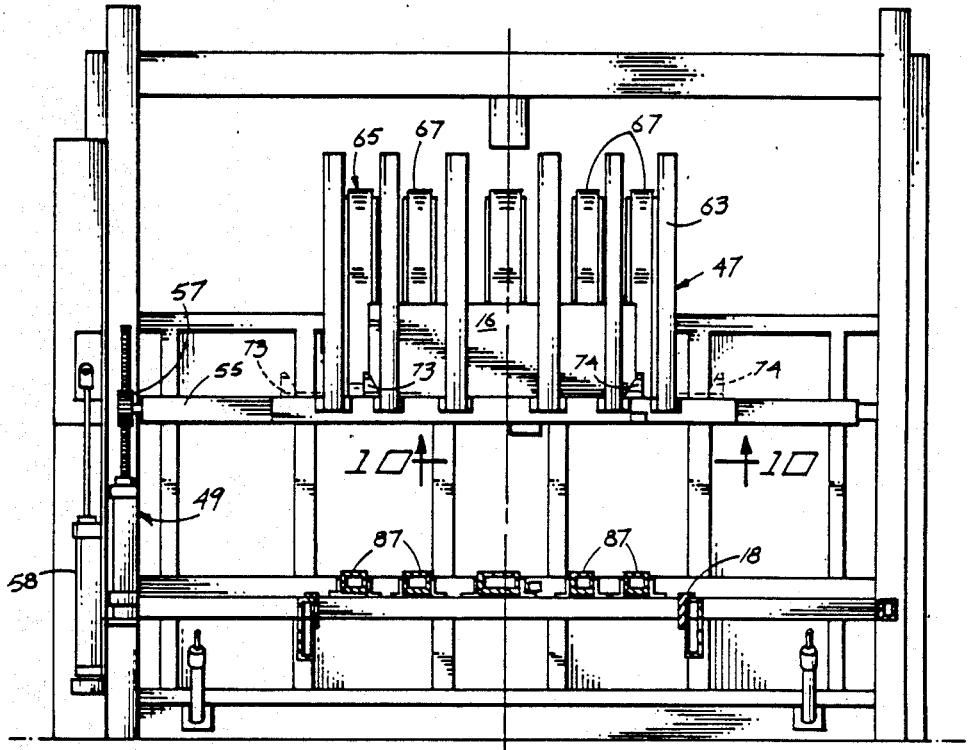
FIG. 3 is a vertical cross-sectional view taken along line 3—3 in FIG. 2, illustrating a block handling means.

The block inverting carriage 47 is part of the block handling means 26. The block handling means 26 includes a carriage pivot drive 49 (FIG. 6 and 7) for pivoting the block inverting carriage 47 from a first horizontal position for receiving the block from the block removing means 41 (FIG. 1*c* and 11), and tipping the block upward (FIGS. 1*e* and 3) and then forward to a horizontal orientation (FIG. 7) to invert the block 16 of sheets. Additionally, a carriage vertical drive 51 is connected to the carriage for raising and lowering the carriage 47 with respect to the feed conveyor 18 and the block removing means 41 for lowering an inverted block and depositing the block on the feed conveyor 18 at the receiving end 88 of the conveyor 18 as illustrated in FIG. 1*f*. Preferably, the carriage pivot drive 49 includes a rack and pinion arrangement 57, and the carriage vertical drive 51 includes a fluid cylinder 58, illustrated in FIGS. 6 and 7.

The carriage 47 is mounted on a shaft 55 that has the pinion portion of the rack and pinion arrangement 57 mounted on an end of the shaft. The carriage 48 is pivoted about the axis of the shaft 55.

The block inverting carriage 47 includes a U-shaped carriage frame 53 (FIGS. 6 and 7) that includes a center frame section 59 and a pickup leg section 61 and a deposit leg 63. The pickup leg section 61 includes a pickup conveyor 65 (FIG. 10) mounted on the carriage for receiving the block 16 of sheets from the block removing means 41, and for moving the block 16 fully onto the carriage 48 with the leading edges of the sheets engaging the center frame section 59. The pickup conveyor 65 has a plurality of conveying belts 67 (FIG. 3) that are driven by a hydraulic motor (not shown). A sensor 68 (FIGS. 1*a*–1*d*) is positioned on the carriage 47 for sensing when the block is fully loaded on the carriage 48.

Figure 4:
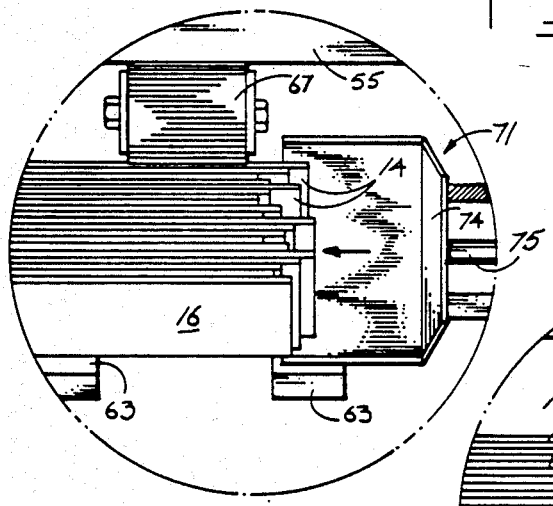
FIG. 4 is an enlarged plan view of a portion of the block handling means illustrating the block prior to alignment.
Figure 5:
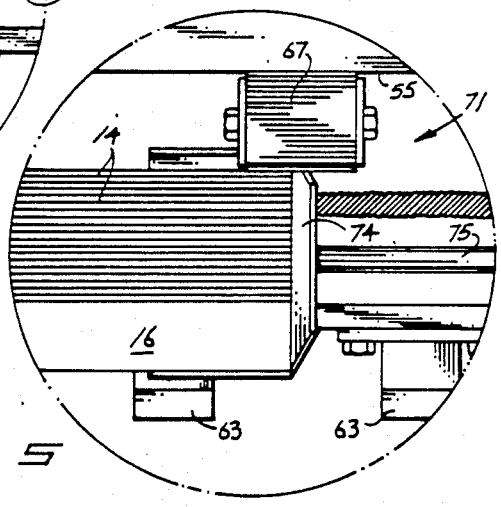
FIG. 5 is a detail plan view similar to FIG. 4 except showing the lateral edges of a block of corrugated sheets being aligned.

A block alignment means 71 (FIGS. 4, 5, 10, and 11) is mounted on the block inverting carriage 47 and specifically on the center frame section 59 for engaging the lateral edges of the sheets 14, and aligning sheets with respect to each other and with respect to the center axis 20 as the block is being inverted. The alignment process is illustrated in sequence in FIGS. 4 and 5. FIG. 4 shows the block 16 of sheets with the lateral edges being unaligned with respect to each other, and the block being unaligned with respect to the central axis. FIG. 5 illustrates the mechanism for aligning the lateral edges of the sheets 14 in the block with respect to each other, and additionally aligning the entire block 16 with respect to the central axis 20.

Figure 10:
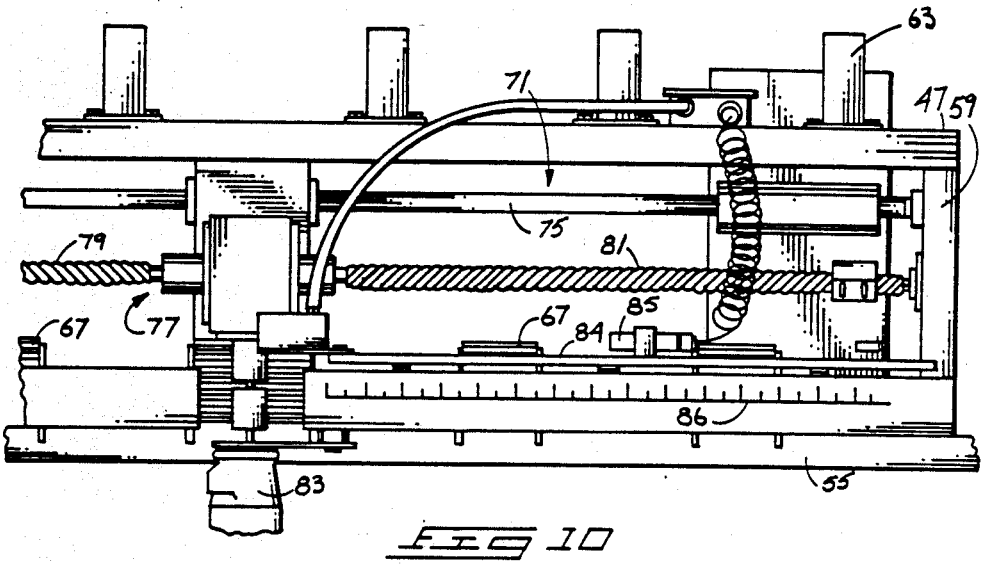
FIG. 10 is a fragmentary cross-sectional view taken along line 10—10 in FIG. 3 showing means for aligning the block of sheets with a central axis of the machine so that the sheets are aligned for feeding to the downstream equipment.

The alignment means 71 includes two opposing alignment plates or elements 73 and 74 (FIG. 2) that are slidably mounted on a guide shaft 75, that is illustrated in FIG. 10. The alignment means 71 includes a unison drive means 77 that is mounted on the carriage for driving the alignment plates 73 and 74 in opposing directions. The unison drive means includes two screws 79 and 81 that are rotated oppositely to move the plates in opposite directions in unison in response to the rotation of the screws. The unison drive means includes a drive motor 83 that is preferably a hydraulic drive motor for driving the screws 79 and 81.

A sensor 85 is adjustably mounted for movement longitudinally with respect to the guide shaft 75 for sensing the location of the alignment plate 74. Sensor 85 is movably mounted upon a sleeve 84 to be adjusted by the operator. A scale 86 is mounted immediately below the sensor 85 to enable the operator to accurately set the position of the sensor 85 in relationship to the center line, depending upon the width of the corrugated sheet. The sensor 85 senses the position of the plate 74 when the plate is in the position illustrated in FIG. 5 to stop any further movement of the plate. Once the alignment is obtained while the sheets are being inverted, the operating system causes the motor 83 to rotate the screws in reverse to move the plates outward away from the lateral edges after alignment has been attained.

Figure 7:
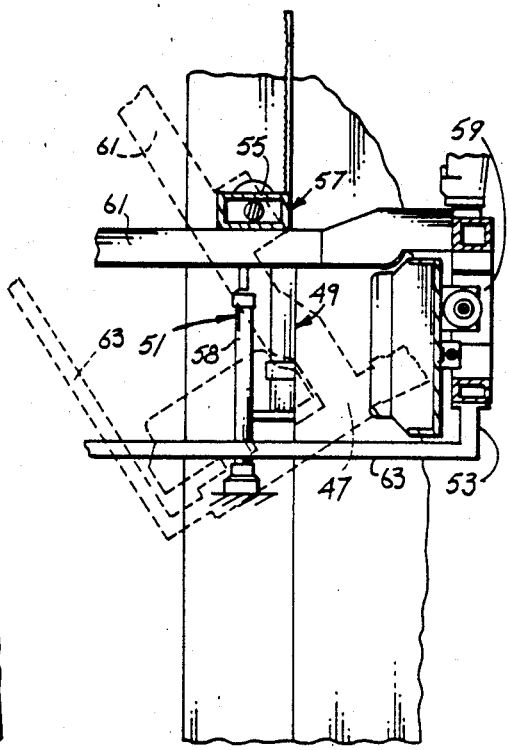
FIG. 7 is a vertical cross-sectional view similar to FIG. 6 except showing the carriage in an inverted position in solid line, and in a partially inverted position in dotted line as the block is being pivoted.

The operator sets the sensor 85 in relationship to the width of the sheet. For example, if the sheet is 72 inches in width, then the sensor will be set in alignment with the 36 inch mark (one-half of 72") on the scale 86 so that the drive motor 83 will stop when the plate has moved to the 36 inch location, indicating that the lateral edges of the sheets 14 are aligned with respect to each other, and that the block 16 of sheets is aligned with respect to the central axis 20. The deposit leg section 63 supports the block after the sheets have been aligned, as illustrated in FIG. 7, and as the block 16 is being lowered to the receiving end of the feed conveyor 18, as illustrated in FIG. 1*f*.

The feed conveyor 18 includes a plurality of continuous conveyor belts 87 (FIGS. 2 and 3) that extend from the receiving end 88 to the discharge end 89 for transferring and moving the block 16 that is deposited at the receiving end toward the discharge end.

Figure 8:
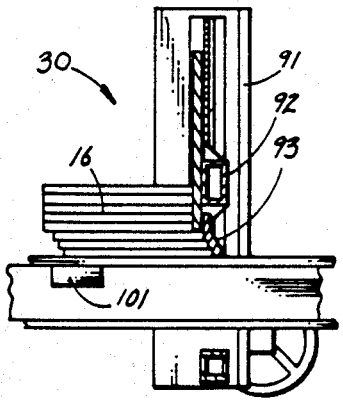
FIG. 8 is a vertical cross-sectional view taken along line 8—8 in FIG. 2, illustrating the shingling assembly with a gate illustrated in the lower position.
Figure 9:
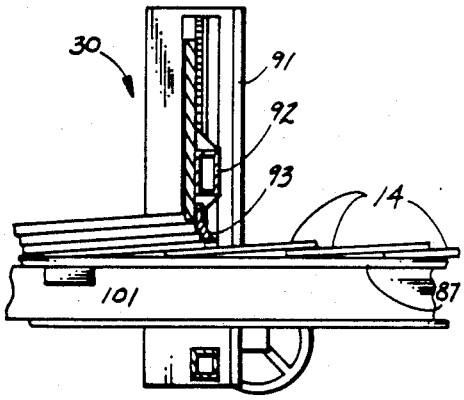
FIG. 9 is a view similar to FIG. 8 except showing the shingling arrangement with the gate in a partially elevated position to shingle the sheets as they move along a feed conveyor.

The shingling means 30 includes a general frame 91 that extends overlying the feed conveyor 18 as illustrated in FIGS. 1*f*, 8 and 9. The shingling means 30 includes a movable gate 92 that is vertically removable with respect to the conveyor surface for adjusting the spacing between the gate 92 and the surface of the conveyor. The gate 92 has an incline throat bar 93 that extends downward and forward for engaging the leading edges of the corrugated sheets. Preferably, the bar 93 has a surface of low friction material such as high density molecular weight plastic material to cause the material to readily shingle and pass beneath the bar 93 as the gate 92 is raised. Although not shown, the shingling means has a drive for raising and lowering the gate during the sequence. When the block 16 is initially received at the shingling means 30, the gate 92 is in the lower position illustrated in FIG. 8. The gate 92 then is progressively raised to permit shingling and the conveyor of the shingled sheets to the discharge end.

A sensor 99 (FIGS. 1*e* and 1*f*) is located at the receiving end to sense when a block 14 has been deposited on the receiving end 88 of the conveyor 18. Additionally, a sensor 101 (FIGS. 8 and 9) is positioned immediately in front of the shingling means 30 to sense when a block has traveled to the shingling means to progressively raise the gate 92 to permit sheets 14 to proceed forward in a shingled fashion.

Figure 6:
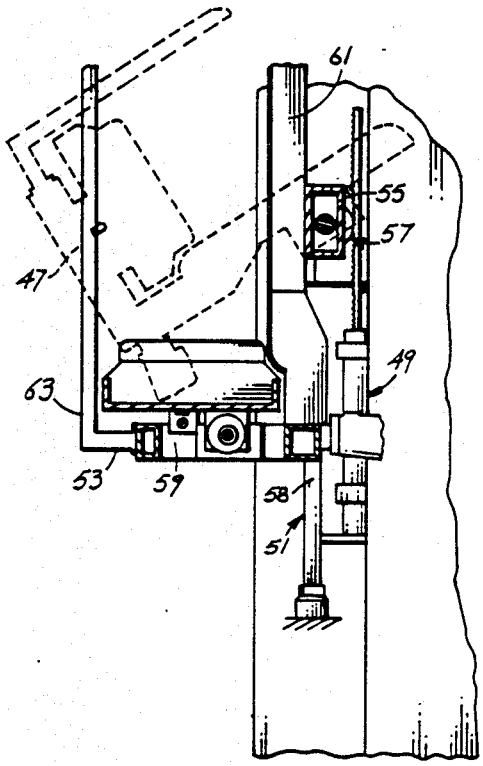
FIG. 6 is a vertical cross-sectional view of the block handling means for receiving a block of corrugated sheet from the top of the stack, in which block handling means is shown with a carriage in a vertical position in solid line, and the carriage shown in dotted line at an incline position as the carriage is being pivoted.

During the operation of the apparatus 10, a stack 12 of corrugated sheets is delivered to the lowered platform 32. The platform 32 then raises the stack 12 until the upper sheet 14 is at a level indicated by the sensor 24. If the block inverting carriage 47 is in its receiving position illustrated in FIG. 11, the block removing means 41 is activated to move the pusher plate 43 forward to push a block 16 of corrugated sheet from the top of the stack 12. The conveying belts 67 are activated on the carriage 47 to move the block fully onto the carriage 47 until the loaded block is sensed by the sensor 68. When the block 16 is fully received on the inverted carriage 47, the carriage pivot drive 49 is activated to progressively pivot and invert the block progressively, as illustrated in FIGS. 6 and 7 from the position shown in FIG. 11 to the position shown in FIG. 7 in solid line.

Very importantly, as the block 16 is being inverted, the alignment means 71 is activated to move the alignment plates 73 and 74 inward as illustrated in FIGS. 4 and 5 to engage the edges of the vertically oriented sheets 14 to align the edges with each other and to additionally align the entire block 16 of sheets with the central axis 20. It has been found that it is much easier and creates less damage to wear of the sheets to move the sheets with respect to each other and to move the block laterally when the sheets are oriented vertically as opposed to when the sheets are oriented horizontally. The coefficient of friction between the sheets dramatically decreases when they are oriented vertically. The drive for the alignment means 71 moves the plates 73 and 74 inwardly against the lateral edges to perform the edge alignment and the block alignment as the sheets are positioned vertically.

The block inverting carriage 47 is progressively moved from the first receiving horizontal orientation through the vertical orientation to the horizontal discharge orientation in a smooth, progressive movement. The alignment is accomplished prior to the total inversion of the block. If the preceding block is not at the receiving end 88 of the conveying belt, then the carriage vertical drive 51 is activated to lower the carriage 47 to the position illustrated in FIG. 1*f* and depositing the block on the conveyor belt. Additionally, it is necessary that the sensor 101 sense that there is no block or sheets at the shingling station 30 before the block is lowered by the inverting carriage 47 to the feed conveyor 18. Once the block at the receiving end 88 is moved to the shingling means 30 as sensed by the sensor 101, then the vertical drive 51 is activated to raise the carriage 47 upward and the carriage pivot drive 49 is activated to pivot the inverting carriage back to the position illustrated in FIG. 11 to receive a subsequent block of corrugated sheets.

As the block 16 moves from the receiving end 88 towards the discharge end 89, the block engages the gate 92. When the sensor 101 senses that the block has been received at the gate 92, the gate 92 is progressively raised as indicated in FIG. 9 to cause the sheets to feed from the bottom of the block in a shingled arrangement. After the block has been dissipated, a signal is generated to cause the succeeding block to be lowered to the feed conveyor.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A corrugated sheet unstacking and feeding apparatus for removing sheets from a vertical stack of sheets and feeding the sheets in a shingled fashion along a feed axis with each sheet being laterally centered with respect to the feed axis; comprising:

a powered elongated feed conveyor extending along a feed axis and having a receiving end and a discharge end;

elevator means for receiving a vertical stack of corrugated sheets and moving the stack upward until the top of the stack reaches a desired elevation above that of the feed conveyor;

block handling means adjacent the receiving end of the feed conveyor for (1) removing a block of sheets from the elevated stack, (2) inverting the block of sheets, (3) aligning lateral edges of the sheets within the block as the block is being inverted, (4) laterally centering the block of sheets with the feed axis, and (5) depositing the centered block of sheets on the receiving end of the feed conveyor laterally centered with the feed axis;

the block handling means comprising:

a block inverting carriage movable with respect to the elevated stack of sheets and the elongated feed conveyor, the block inverting carriage being both vertically movable from an elevated position adjacent the top of the elevated stack to a lowered position adjacent the receivng end of the feed conveyor, and being movable from a first pivot position for receiving an uppermost block of sheets from the elevated stack through a second pivot position in which the block of sheets is vertically oriented, and to a third pivot position in which the block of sheets is inverted from its original orientation in the elevated stack;

the block inverting carriage including laterally opposed alignment elements mounted to the carriage for movement in unison with it;

drive means operably connected between the carriage and alignment elements for moving the alignment elements laterally inward with respect to the moving carriage and the feed axis for (1) aligning the edges of the sheets within the block with each other and (2) shifting the block of sheets laterally with respect to the moving carriage to center the block relative to the feed axis; and shingling means along the feed axis between the receiving end and the discharge end of the feed conveyor for engaging the moving inverted laterally aligned block and feeding the sheets to the discharge end in a sequential shingled fashion.

2. The corrugated sheet unstacking and feeding apparatus, as defined in claim 1, wherein the block handling means includes:

block removing means adjacent the elevated position of the block inverting carriage for moving the uppermost block from the stack to the block inverting carriage; and operating means to sequentially operate the block inverting carriage, the block removing means and the alignment elements for (1) removing the uppermost block of sheets from the stack and onto the inverting carriage, (2) pivoting the carriage to position the block into a vertical orientation and then to an inverted position relative to its original orientation in the elevated stack, (3) centering the block with the feed axis while the block of sheets is vertically oriented, and (4) lowering the laterally aligned block into an inverted position and onto the receiving end of the feed conveyor.

3. The corrugated sheet unstacking and feeding apparatus as defined in claim 1 wherein:

the drive means is a unison drive means for moving the laterally opposed adjustment elements in unison (i) to align the block with the feed axis and (ii) outwardly apart to release the block when the block is lowered onto the receiving end of the feed conveyor.

4. The corrugated sheet unstacking and feeding apparatus as defined in claim 1 wherein the corrugated sheets have a known width, and further comprising:

control means operatively connected to the drive means for sensing when the spacing between the opposed alignment elements is substantialy equal to the width of the corrugated sheets to stop further inward lateral movement of the alignment elements and for activating the drive means to move the alignment elements laterally outward.

5. The corrugated sheet unstacking and feeding apparatus as defined in claim 1 wherein the drive means includes rotatable feed screws mounted for opposing rotation, the rotatable feed screws being operatively connected to the respective opposing alignment elements to move the alignment elements in unison in opposite directions as the feed screws are rotated.

6. The corrugated sheet unstacking and feeding apparatus as defined in claim 4 wherein the control means has adjustable sensing means that may be adjusted when the width of the corrugated sheets changes.

* * * * *